United States Patent [19]

Pollich

[11] Patent Number: 4,693,462

[45] Date of Patent: Sep. 15, 1987

[54] SHEET DELIVERY APPARATUS FOR PRINTING MACHINES

[75] Inventor: Gerhard Pollich, Heidelberg, Fed. Rep. of Germany

[73] Assignee: Heidelberger Druckmaschinen AG, Heidelber, Fed. Rep. of Germany

[21] Appl. No.: 218,544

[22] Filed: Dec. 22, 1980

Related U.S. Application Data

[63] Continuation of Ser. No. 21,954, Mar. 19, 1979, abandoned.

[30] Foreign Application Priority Data

Mar. 18, 1978 [DE] Fed. Rep. of Germany ..... 2811963

[51] Int. Cl.[4] ..... B65H 29/68

[52] U.S. Cl. ..... 271/183; 271/231

[58] Field of Search ..... 271/183, 204, 205, 206, 271/182, 196, 197, 231, 270, 202, 276, 69, 314, 272, 273, 274; 198/780, 782

[56] References Cited

U.S. PATENT DOCUMENTS

| | | | |
|---|---|---|---|
| 2,287,719 | 6/1942 | Beasley | 271/270 |
| 2,643,121 | 6/1953 | Backhouse | 271/231 |
| 3,451,670 | 6/1969 | Staines | 271/183 |
| 3,907,274 | 9/1975 | D'Amato et al. | 271/183 X |
| 4,030,727 | 6/1977 | Jeschke | 271/197 X |
| 4,131,420 | 12/1978 | Miller | 198/791 X |
| 4,167,997 | 9/1979 | Revells | 198/780 X |

*Primary Examiner*—Andres Kashnikow

*Attorney, Agent, or Firm*—Herbert L. Lerner; Laurence A. Greenberg

[57] ABSTRACT

The invention relates to a sheet delivery apparatus on printing presses which is fitted with pneumatically operating braking mechanisms and the function of which is to retard and tighten the merging sheet which is to be deposited. The pneumatic braking mechanisms may be of unipatite or bipartite construction and are fitted with braking rollers pressurized with suction air and adjusted to run on print-free areas of the printed image in order to prevent set-off of the newly printed underside of the sheet. In order to allow for adaptation of the braking force of the braking rollers to various types of paper and bearing in mind the varying width of the print-free areas of the sheet, depending upon the printed product, the braking rollers are disposed on a support shaft below the chain delivery and in front of the delivery pile and can readily be interchanged with others having wider or narrower sheet support areas. Depending upon whether the braking mechanisms are of unipartite construction as braking rollers having suction chambers and a vaccum feed integral therewith or of bipartite construction as braking rollers with separate slip-on suction members, the support shaft is of unipartite continuous construction or of multipartite and separable construction.

4 Claims, 8 Drawing Figures

SHEET DELIVERY APPARATUS FOR PRINTING MACHINES

This is a continuation of application Ser. No. 021,954, filed Mar. 19, 1979, now abandoned.

The invention relates to a sheet delivery apparatus for printing machines having pneumatic braking mechanisms at the chain delivery which are disposed as rotating braking rollers pressurized with suction air on a support shaft extending transversely to the direction of sheet feed and located below the chain feed in front of the delivery pile for braking and tightening the emerging sheet.

In sheet delivery apparatus with braking mechanisms of this type, the braking effect on the end of the emerging sheet to be deposited on the delivery pile is achieved by means of a lower circumferential speed of the suction braking rollers with respect to a higher revolving speed of the chain grippers corresponding to the sheet speed. In addition, due to the difference in speed existing between the suction braking rollers and the sheet, the latter is also tightened. The instant the leading edge of the sheet is released by the chain grippers, the suction braking rollers exert a braking effect upon the trailing end of the sheet and retard the sheet until the trailing edge thereof leaves the suction braking roller, so that the tightened sheet is evenly deposited on the delivery pile at approximately the same speed as the circumferential speed of the suction braking rollers.

Especially with first form and perfector printing work, the high speed differential between the suction braking rollers and the sheet may cause the freshly printed underside of the sheet to setoff on the suction braking rollers, which makes it necessary for these rollers to be positioned only on print-free areas of the sheet.

Braking mechanisms have become known heretofore which take into account the factors described hereinbefore insofar as the suction braking rollers thereof can be displaced sidewise onto print-free areas of the sheet. In practice, however, the difficulty arises that, especially in the case of first form and perfector printing work, often only extremely narrow print-free areas are available within the printed image, so that wide suction rollers i.e. suction rollers with a wide sheet support surface, can no longer be used.

In order to counteract this, it is possible to fit the braking mechanisms with suction braking rollers having a narrow sheet support area or surface with a width of 2 to 3 mm, for example, which would solve the hereinaforementioned problems. With regard to the suction and braking force thereof, however, this type of suction braking roller with a narrow sheet support surface also has limits which can be overcome only with a disproportionately large expense, since the suction effect thereof on heavy papers, such as over 130 g/m$^2$, for example, and at maximum speed is inadequate to retard the sheets to the desired extent.

The option therefore exists when assembling the machine, either to provide suction braking rollers with a wide suction and sheet support surface in the braking mechanisms and thus achieve a good braking effect or, on the other hand, to provide suction braking rollers with a narrow suction and sheet support surface and necessarily accept an inadequately small braking effect when working heavier papers or cardboard. An increase in braking effect as a result of an increased vacuum is possible only to a limited extent for production reasons and having regard to the expense, as well as the means and also the cost involved.

Proceeding from this state of the art, it is an object as well as a fundamental task of the invention to provide a sheet delivery apparatus with pneumatic braking mechanisms which allows the braking force thereof to be quickly and simply adapted to the particular type of paper being worked in order to achieve optimum braking effect on the sheets to be deposited.

With the foregoing and other objects in view, there is provided in accordance with the invention, in sheet delivery apparatus for printing machines having a chain delivery device for delivering a printed sheet to a delivery pile, pneumatic braking means comprising rotary braking rollers having suction air admitted thereto, a support shaft extending between side walls of the printing machine adjacent and upstream of the delivery pile in travel direction of the chain delivery device, the support shaft being disposed transversely to the travel direction below the chain delivery device and rotatably carrying the braking rollers, the pneumatic braking means beind disposed so as to brake and tighten the sheet to be delivered, and means for interchanging pneumatic braking means having a sheet supporting surface of a given type of construction with other pneumatic braking means having a sheet supporting surface of a different type of construction. With this construction, immeiate account can be taken of a change in the print-free areas of the printed image as well as of the selection of a different type of paper, through the possibility of extremely rapidly changing the braking mechanisms with a small expense in labor.

In accordance with another feature of the invention the support shaft is of unipartite construction, and the braking means are so disposed thereon so as to be removable therefrom and slippable thereon. This problem-free structure guarantees ease of operation of the braking meachanisms since only a few manipulations are required to interchange them.

In a further embodiment of the inventive concept, which is especially suitable for the application of almost all familiar and conventioal suction rollers and can be produced at extremely reasonable cost owing to the small construction expense and, in addition, ensures minimal exchange times, the support shaft on which the braking mechanisms are removably mounted is of multipartite and separable construction. In the interest of further simplification and time-saving when interchanging the braking rollers, the braking mechanisms are of unipartite construction as braking rollers with suction chambers and a vacuum feed integral therewith, the drive of the braking rollers being effected by means of separate drive wheels.

In accordance with an addition feature of the invention, the support shaft is bipartite, one of the support shaft parts located at one of the two walls of the machine is shorter at least by the width of the braking rollers than the inner spacing between the two walls, and the other of the support shaft parts serves as a bridging member from the one of the support shaft parts to the other of the two walls, the other of the support shaft parts being withdrawable from the other of the two walls.

In accordance with yet another feature of the invention, the support shaft is bipartite, one of the support shaft parts comprising a coupling provided at one of the side walls, and the other of the support shaft parts is disposed so as to be uncouplable from the coupling and withdrawable out of the other of the side walls.

In accordance with yet a further feature of the invention, the support shaft is of tripartite construction and comprises respective couplings mounted at the respective side walls of the machine, and a middle support shaft part removably coupled at both ends thereof to the respective couplings.

In accordance with yet an added feture of the invention, the support shaft is of tripartite construction and comprises an articulating joint mounted at one of the side walls of the machine, a coupling at the other of the side walls, and a middle support shaft part uncouplable at one end thereof from the coupling and articulatingly connected to the joint at the other end thereof.

In accordance with yet an additional feature of the invention, there is provided in sheet delivery apparatus for printing machines having a chain delivery device for delivering a printed sheet to a delivery pile, pneumatic braking means comprising rotary braking rollers having suction air admitted thereto, a support shaft extending between side walls of the printing machine adjacent and upstream of the delivery pile in travel direction of the chain delivery device; the support shaft being disposed transversely to the travel directio below the chain delivery device and rotatably carrying the braking rollers, the pneumatic braking means being disposed so as to brake and tighten the sheet to be delivered, the braking rollers thereof being of unipartite construction and being formed in a sheet supporting surface thereof with suction chambers recessed therein and having the suctio-air feed integral therewith, and drive means for rotating the braking rollers, the drive means comprising separate drive wheels for the respective braking rollers.

In accordance with another feature of the invention, the sheet delivery apparatus includes support means mountable on the support shaft and having ends to which the suction air feed is fixed while the braking rollers are rotatable.

In accordance with a further feature of the invention, the drive means further comprise at least one revolving drive belt, respectively, connected to the drive wheels and the braking rollers. In accordance with an added feature of the invention, there is provided in sheet delivery apparatus for printing machines having a chain delivery device for delivering a printed sheet to a delivery pile, pneumatic braking means comprising rotary braking rollers having suction air admitted thereto, a support shaft extending between side walls of the printing machine adjacent and upstream of the delivery pile in travel direction of the chain delivery device, the support shaft being disposed transversely to the travel direction below the chain delivery device and rotatably carrying the braking rollers, the pneumatic braking means being disposed so as to brake and tighten the sheet to be delivered, the braking rollers thereof being of bipartite construction and comprising a first part formed as a roller member, and a second part formed as a separate suction member having a suction-air feed integral therewith, a cross shaft extending parallel to the support shaft between the side walls of the machine and carrying the second part in a manner that it is slippable onto the respective braking roller, the second part being releasably lockable on the cross shaft.

In accordance with an additional feature of the invention, the braking means further comprise a braking member in the form of a thin braking belt having a narrow and continuous closed belt surface for contacting a delivered printed sheet to be braked, the braking belt being revolvable within the region of action of the suction member for braking the printed sheet so as to retard the delivery thereof.

In accordance with yet another feature of the invention, at least one of the braking rollers is formed with a narrow-sheet-supporting surface, the respective suction member comprises one suction-air chamber having a single elongated air inlet orifice, and the braking means further comprise a braking belt having a width relatively smaller than that of the suction air inlet orifice and being disposed in the middle of and wound around the braking roller, the single suction air inlet orifice of the suction air chamber applying suction to the underside of a sheet being delivered so as to draw it onto the belt surface.

In accordance with yet a further feature of the invention, at least one of the braking rollers is formed with a narrow sheet-supporting surface, the respective suction member comprises two interconnected suction air chambers disposed on opposite sides of the braking roller and a common suction air feed connected thereto for simultaneously applying suction thereto, each of the suction air chambers having an elongated suction air inlet orifice, and the braking means further comprise a single braking belt wound around the braking roller between the two suction chambers, the two suction air inlet orifices of the suction air chambers mutually applying suction to the underside of a sheet being delivered so as to draw it onto the belt surface.

In accordance with yet an added feature of the invention, the first-mentioned pneumatic braking means have a sheet supporting surface which is of different width from that of the sheet supporting surface of the second-mentioned pneumatic braking means.

Other features which are considered as characteristics for the invention are set forth in the appended claims.

Although the invention is illustrated and described herein as embodied in sheet delivery apparatus on printing presses, it is nevertheless not intended to be limited to the details shown, since various modifications and structural changes may be made therein without departing from the spirit of the invention and within the scope and range of equivalents of the claims.

The construction and method of operations of the invention, however, together with additional objects and advantages thereof will be best understood from the following description of specific embodiments when read in connection with the accompanying drawings, in which.

Figure 4:
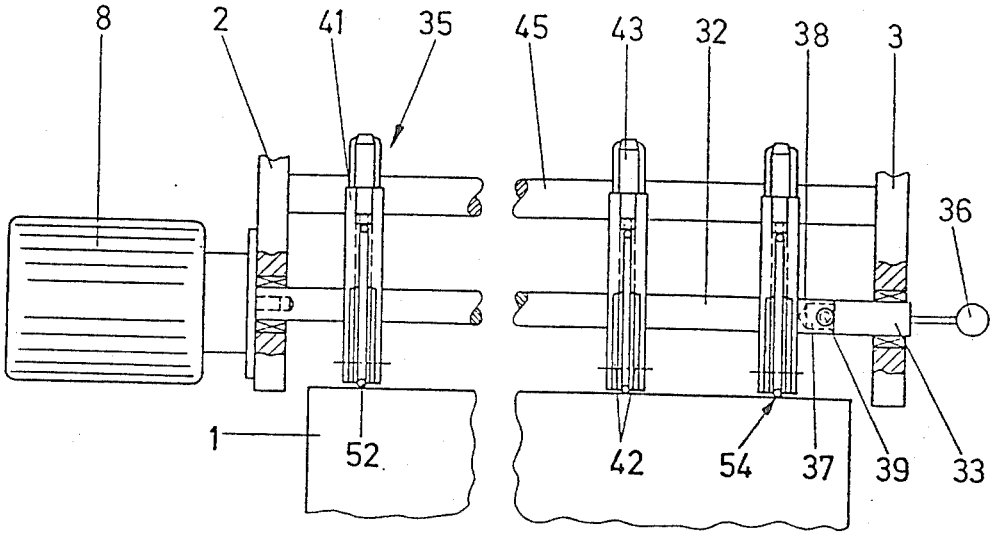
FIG. 4 is a view similar to that of FIG. 1 of another embodiment of the invention having bipartite braking mechanisms separable on the operating side, and braking rollers with a relatively narrow sheet-supporting surface.
Figure 7:
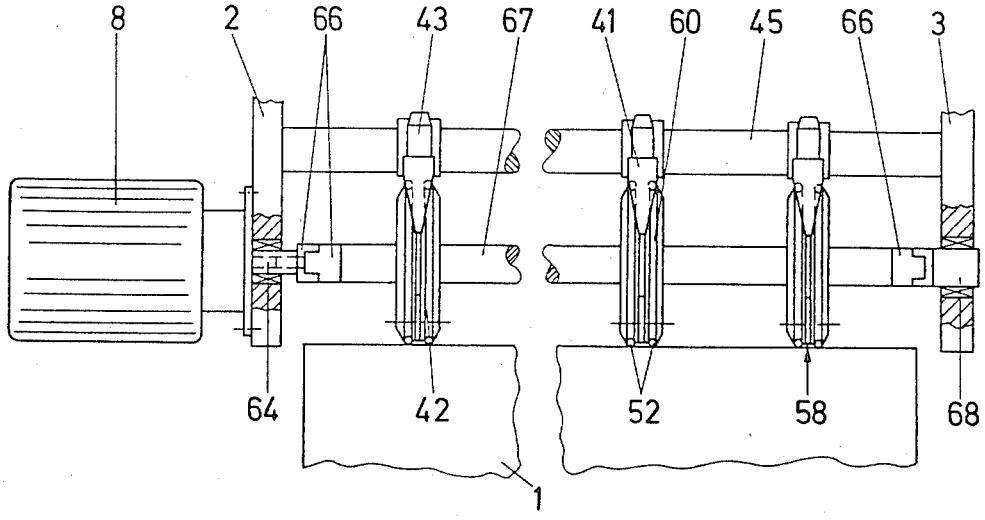
Figure 8:
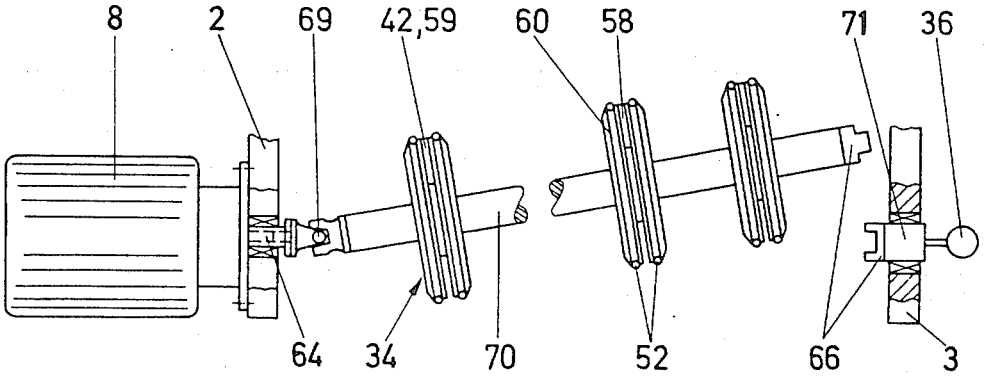

FIG. 7 is a view similar to that of FIG. 4 of a modified third embodiment of the bipartite braking meachnisms having a multipartite support shaft uncouplable on both sides and having braking rollers with a relatively wide sheet-supporting surface; and FIG. 8 is yet another view similar to that of FIG. 4 of a modified fourth embodiment of the bipartite braking mechanisms having a multipartite support shaft uncouplable on the drive side and swivelled on the operating side, and having braking rollers with a relatively wide sheet-supporting surface.

Figure 1:
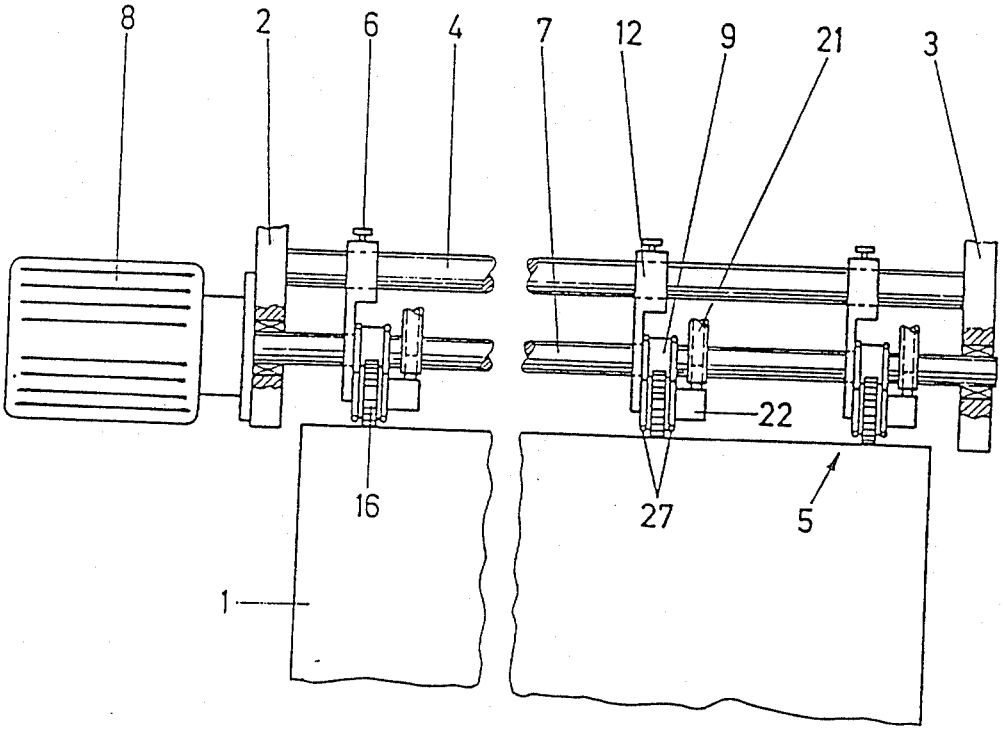
FIG. 1 is a diagrammatic top plan view, partly broken away and partly in section, of a basic construction of an embodiment of a sheet delivery device of a printing press, according to the invention, having unipartite braking mechanisms with a unipartite support shaft and separate drive.

Referring now to the drawing and first, particularly, to FIG. 1 thereof, there is shown, in a basic construction of an embodiment of the invention, in front of a delivery pile 1 of an otherwise non-illustrated sheet delivery, a support shaft 4 secured in the side walls 2 and 3 of a suction roller carriage that is also otherwise non-illustrated. Individual slip-off and slip-on unipartite braking mechanisms 5 are displaceably disposed on the support shaft 4 in arbitrarily selective spaced relationship to one another and are fastenable by means of clamping screws or setscrews 6.

Staggered or offset with respect to the support shaft 4, below and in front thereof, as viewed in sheet travel direction, a drive shaft 7 is supported in the side walls 2 and 3 and is driven by a motor 8 flanged to the outside of the sidewall 3. Drive wheels 9 are disposed on the drive shaft 7 at spaced intervals corresponding to the spaces intermediate the unipartite braking mechanisms 5, and located opposite thereto. The drive wheel s9 are fixed only in circumferential direction, and are guided in axial direction by the unipartite braking mechanisms 5.

Figure 2:
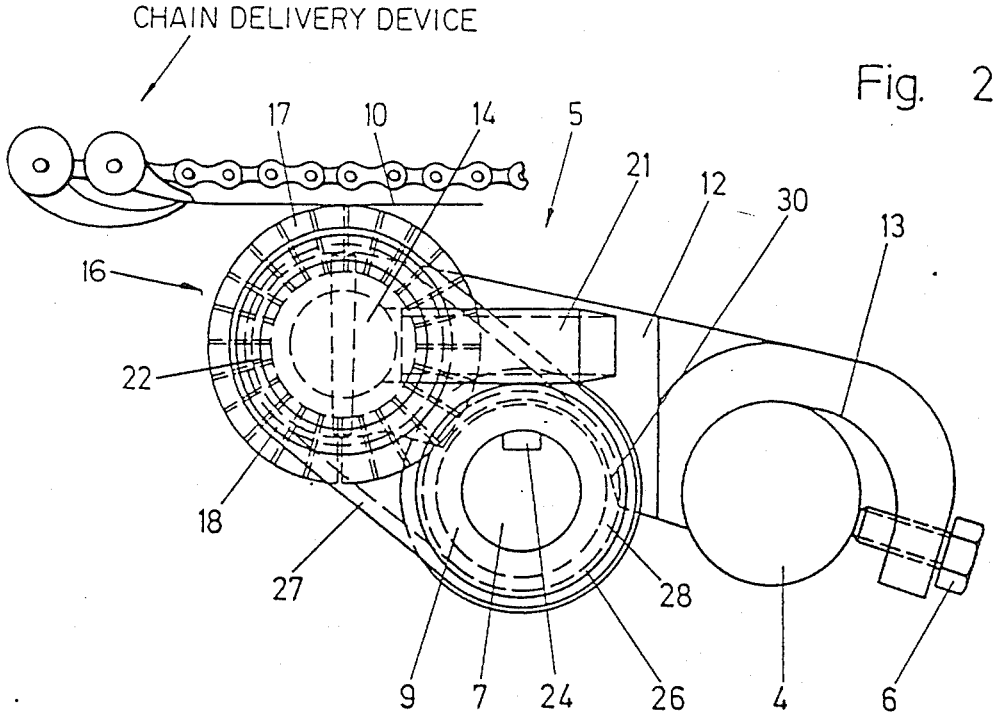
FIG. 2 is an enlarged side elevational view of FIG. 1 with the right-hand side wall removed.
Figure 3:
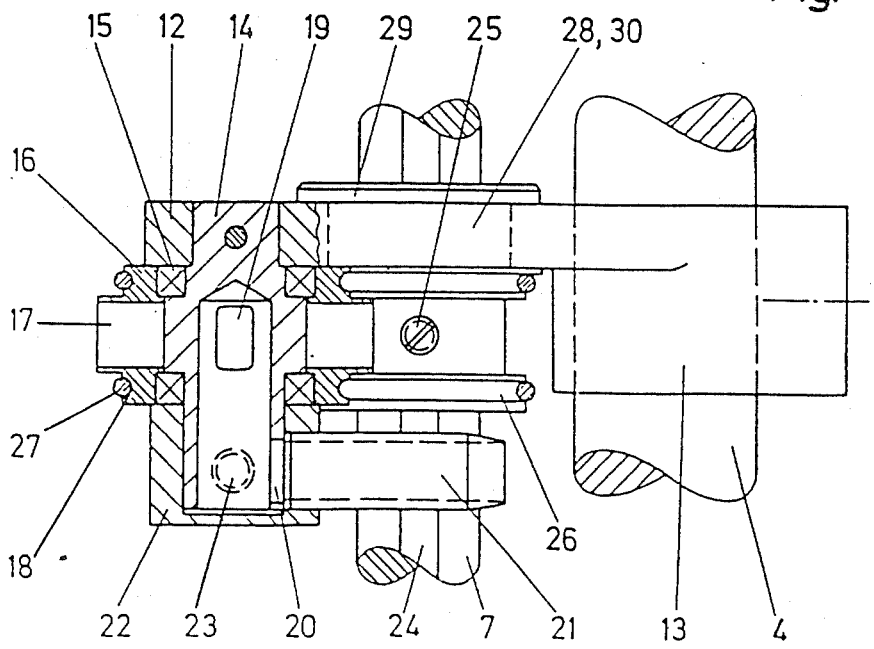
FIG. 3 is a top plan view, partly in section, of FIG. 2.

According to FIGS. 2 and 3, each of the unipartite mechanisms 5, respectively, is formed of a support 12, the rear end of which is constructed somewhat as a semicircular bearing shell 13, the support 12 being slippable onto the support shaft 4. The hereinaforementioned clamping screws or setscrews 6, which are sunk, respectively, through the end portion of the bearing shell 13, serve to lock the respective support 12 in position. At the forward or front end of the support 12, a suction air-chamber sleeve 14 is secured whereon a braking roller 16 is supported by means of ball bearings 15. Suction chambers 17 are machined into the braking rollers 16 penetrating to the casing surface of the suction air-chamber sleeve 14, so that the braking roller 16 has theform of a webbed or studded wheel. In addition, the braking rollers 16 are formed with two drive grooves 18 at both sides thereof.

An inner air-inlet orifice 19 is machined into the peripheral part of the suction air-chamber sleeve 14 at the upper side of the support 12 and facing toward the sheet 10 that is to be braked, the air-inlet orifice 19 being congruent or coincident with the braking roller 16 supported on the sleeve 14. In a similar manner, the free end of the suction air-chamber sleeve 14 is provided with an outer air inlet orifice 20 congruent or coinciding with the suction air channel of a suction air or vacuum feed 21 which is mounted on an air inlet sleeve 22. The air inlet sleeve 22 is slipped onto the free end of the suction air-chamber sleeve 14 and securable thereon by means of a stud bolt or headless screw 23.

The drive wheels 9, corresponding in number to the number of supports 12, are disposed on the drive shaft 7 and displaceable thereon in an elongated slot or keyway 24, and are fixed in circumferential direction therein by means of entrainer screws 25.

The drive wheels 9 are provided on both sides thereof with drive grooves 26 which are disposed opposite and in alignment with the drive grooves 18 formed in the braking rollers 16. Drive belts 27 revolve in the drive grooves 26 and span or encircle the braking rollers 16 in the drive grooves 18 thereof. Preferably, drive belts 27, having a circular cross section, are employed. It is within the scope of the invention, however, to use other types of belts, such as belts with flat or trapezoidal profiles, for example. Naturally, the drive of the braking rollers 16 can also be effected by means of toothed belts and toothed belt pulleys.

As shown in FIGS. 2 and 3, the drive wheels 9 are furnished on one side thereof with a guide groove 28 which is limited or defined by a lateral support collar 29.

The supports 12, tightly clamped on the unipartite support shaft 4 have a semicircular support shoulder 30 machined therein and are disposed therewith in the guide groove 28, thereby preventing any undesired axial displacement of the drive wheels 9.

Instead of using drive belts 27, the drive wheels 9 can be provided with toothing, the revolving teeth of which engaging in the suction chambers 17 of the braking rollers 16 and thereby driving the latter.

The manner of operation as well as the manipulation of the unipartite braking mechanisms according to the invention, so as to exchange them with other braking mechanisms having differently formed sheet supporting surfaces, is as follows:

The rotary motion of the drive wheels 9 on the drive shaft 7 driven by the motor 8, is transferred to the braking rollers 16 either by means of the drive belts 27 or the toothing on the braking rollers 16. In this regard, the suction air of the otherwise non-illustrated vacuum generator is introduced through the suction air channel of the suction air or vacuum feeds 21 through the outer air inlet orifice 20 into the suction air-chamber sleeve 14 and travels from there through the inner air inlet orifice 19 only to the vertically uppermost suction chambers 17 of the braking rollers 16 whereon the sheet 10 rests, so that no false or stray air can be sucked in (FIG. 2).

To exchange the unipartite braking mechanisms 5, the drive belts 27 are manually lifted out of the drive grooves 18 and 26 of the drive wheels 9 and the braking rollers 16 and slipped off. The clamping screws 6 of the support 12 are then loosened so that the latter can be removed upwardly from the support shaft 4 and can be exchanged with unipartite braking mechanisms 5 having braking rollers 16 of narrower or wider construction.

They are then simply slipped onto the support shaft 4 from above again, the guide groove 28 serving as guide band bearing for the supports 12. The drive wheels 9 are thereby automatically disposed in alignment with the braking rollers 16. The newly inserted braking mechanisms 5 are secured by means of the clamping screws 6. Finally, the drive belts 27 are again inserted into the drive grooves 18 and 26 so that they span or encircle the drive wheels 9 and the braking rollers 16.

To laterally shift or displace the unipartite braking mechanisms 5 onto print-free strips of the printed image, it is necessary only to loosen the clamping screws 6 of the supports 12, and to retighten them after the supports 12 have been laterally positioned together with the drive wheels 9 that have been fixed only in circumferential direction i.e. against rotation.

Figure 5:
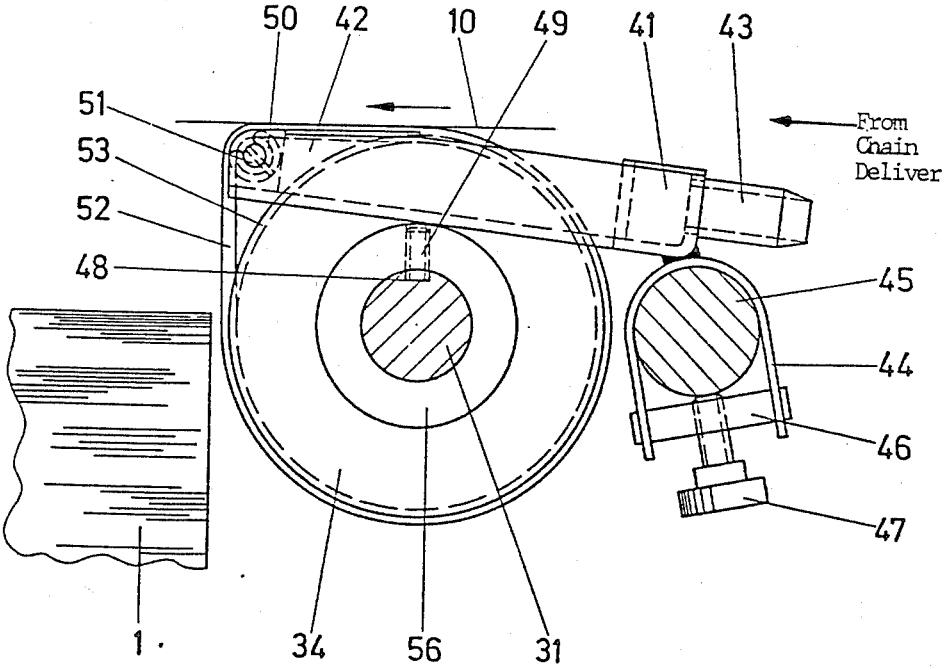
FIG. 5 is an enlarged side elevational view, partly in section, of FIG. 4, with the right-hand side wall removed and showing one of the bipartite braking mechanisms with a separate cross bar.

In an embodiment of the invention according to FIGS. 4 and 5, the support shaft 31 is of bipartite construction and functions simultaneously as a drive shaft. It is subdivided into a lon support shaft section 32 and a short support shaft section 33, the drive being effected by a motor 8 flanged to the side wall 2 in which the long support shaft section is supported in diagrammatically indicated bearings. The long support shaft section 32, the end thereof facing toward the side wall 2 and the drive side of the machine, must be shorter than the inner spacing between the side walls 2 and 3 at least by the width of one braking roller 34 of a bipartite braking mechanism 35 disposed on the support shaft 31 at selective or optional spacing from one another. The short support shaft section 33 is formed as a plug-in shaft for bridging the gap between the long support shaft section 32 and the side wall 3, and is withdrawable from the side wall 3 by means of a handle 36. The plug-in shaft 33 has a shaft journal 37 at an end thereof, the journal 37 being insertable into a bore 38 machined into the end of the long support shaft section 32. Both support shaft sections 32 and 33 can be secured to one another by means of a setscrew 39 or, in place thereof, by means of any other conventional locking or securing element, such as a ball detent, for example.

In accordance with FIGS. 5 to 8, a bipartite braking mechanism 35 is respectively formed of one of the previously hereinabovementioned braking rollers 34 as well as of a separate suction member 41 slippable onto the braking roller 34 and which, depending upon the width of the sheet support surface, is furnished with one or more suction chambers 42 which are connected through a vacuum or suction-air feed 43 to the otherwise non-described and non-illustrated vacuum generator. The suction member 41 is fixed to a bearing clamp 44 which is slipped from above onto a cross shaft 45 secured in the side walls 2 and 3 and extending parallel to and in the same horizontal plane as the bipartite support shaft 31, however, in front or upstream of the latter, as viewed in the travel direction of the sheet 10 represented by the arrow shown in FIG. 5. The securing of the bearing clamps 44 on the cross shaft 45 is effected by means of a strap or shackle 46 inserted into the bearing clamp 44 below the cross shaft 45 and which is provided with a setscrew 47 in the middle thereof.

The braking rollers 34 are provided with entrainer screws 49 that extend into an elongated slot or keyway 48 formed in the bipartite support shaft 31 which prevents movement of the braking rollers 34 in circumferential direction thereof while affording slidability of the braking rollers 34 along the keyway 48. At the front end of the suction member 41 slipped or stuck onto the braking rollers 34, a rotary idler 51 is received in a bearingshaped recess 50. The braking rollers 34 as well as the idlers 51 are, respectively, spanned or encircled by at least one brake band 52 which is guided in grooves 53 machined laterally in the braking rollers 34 (FIG. 5).

Figure 6:
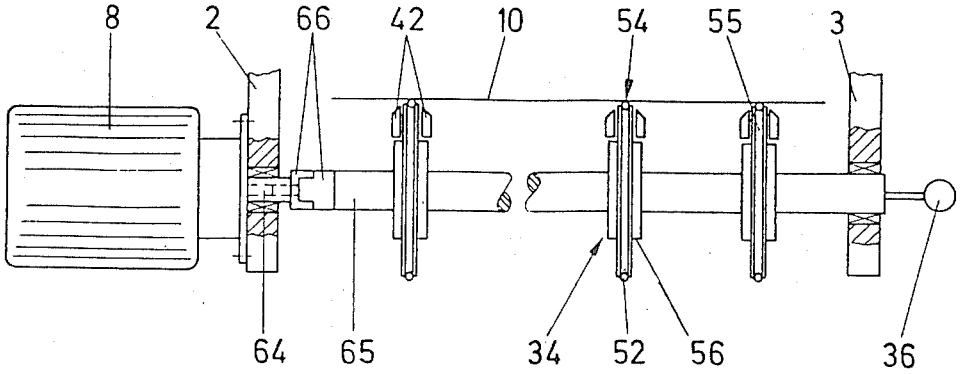
FIG. 6 is a view similar to that of FIG. 4 of a modified second embodiment of the bipartite braking mechanisms having a multipartite support shaft uncouplable on the drive side and having braking rollers with a relatively narrow sheet-supporting surface.

The construction varies depending upon whether the braking rollers 34 of the bipartite braking mechanisms 35 are provided with a narrow or wide sheet support surface 54. The braking rollers 34 with a narrow sheet support surface 54, as shown in FIGS. 4 to 6, have a continuous or penetrating middle crosspiece or web 55 and hub attachments 56 on both sides thereof. The middle crosspiece 55 of the braking rollers 34 having a narrow sheet support surface 54 is provided with a semicircular groove 53 in which there is embedded the brake band 52 by means of which the sheet 10 to be transported is braked. According to FIG. 4, with this arrow sheet-supporting surface version, a suction member 41 is employed which is subsdivided into two separate suction chambers 42 by a middle recess and is truck onto the middle crosspiece 55 of the braking rollers 34 so that both suction chambers 42 come to rest upon the hub attachments 56 of the braking rollers 34 on both sides of the middle crosspiece 55.

In the braking rollers 34 having a wide sheet support surface 58, as shown in FIGS. 7 and 8, a wide recess 59 is centrally formed, limited by the two side walls 60, on which, respectively, a brake band 52 runs in respective grooves 53. A suction member 41 with a single suction chamber 42 is inserted, respectively, into the wide recess 59 formed in the braking rollers 34 having the wide sheet support surface 58.

Exchange of the hereinaforedescribed embodiment of the bipartite braking mechanisms 35 occurs in the following manner:

To replace the braking rollers 34 having a narrow sheet support surface 58, the one brake band 52 spanning or encircling each middle crosspiece 55 and idler 51 must first be removed manually. Then, by means of the setscrews 47, the suction members 41 are released from the suction-air or vacuum feed 43 thereof sufficiently so as to permit the straps or shackles 46 to be removed from the bearing clamps 44. The suction members 41 can then be removed from above from the cross shaft 45.

Thereafter, the bipartite support shaft 31 is divided by releasing both support shaft sections 32 and 33 through loosening the setscrew 39, and the plug-in shaft 33 can be withdrawn by means of the handle 36, from the long support shaft section 32 remaining in position, as well as from the side walal 3.

The braking rollers 34 which are secured at locations in the slot or keyway 48 only in circumferential direction i.e. only against rotation, can then be withdrawn, together with the brake bands 52 thereof, from the long support shaft section 32 through an exposed opening next to the side wall 3 and, in place thereof, braking rollers 34 having a wide sheet support surface 58 are slid onto the long support shaft section 32. The newly installed braking rollers 34 are then laterally shifted or displaced onto print-free areas of the printed image and are secured by means of the setscrews47. Thereafter, the plug-in shaft 33 is reinserted into the side wall 3 so that the shaft journal 37 comes to lie within the bore 38 formed in the end of the long support shaft section 32. After the plug-in shaft 33 is again locked with the long support shaft section 32, the individual suction members 41 with the respective suction-air or vacuum feed 43 thereof are slipped from above onto the cross shaft 45 and inserted into the wide recesses 59 formed in the braking rollers 34 having the wide sheet support surface 58 are then again manually disposed upon the idlers 51. The bipartite braking mechanisms 35 assembled in the foregoing manner are then ready for operation.

It is self-evident that the sequence operations in the course of exchanging the bipartite braking mechanisms 35 is alterable at will i.e. that, for example, the suction members 41 with the respective vacuum feed 43 thereof can be replaced first, and only then will the braking rollers 34 be exchanged, or the operation may also be affected in reverse sequence.

In a second embodiment of the bipartite braking mechanisms 35 with a separable or divisible support shaft, as shown in FIG. 6, the outwardly traveling sheet 10 is retarded by braking rollers 34 having a narrow sheet support surface 54. The support shaft of FIG. 6 is of bipartite construction, a coupling 66 being inserted between a drive pin 64 supported in diagrammatically indicated bearings in the side wall 2 and a long support shaft section 65 mounted in bearings in the side wall 3. To replace the bipartite braking mechanisms 35, the long support shaft section 65 must be uncoupled from the drive pin 64 and then withdrawn from the side wall 3, by means of the handle 36, a distance equal to at least the width of one braking roller 34. The exchange of the bipartite braking mechanisms 35 per se is effected in the hereinaforedescribed manner.

As shown in FIG. 7, in a third embodiment of the bipartite braking mechanism according to the invention, the support shaft is of tripartite construction. It has a long support shaft section 67 in the middle thereof, which is connected by a pair of couplings 66, respectively, with the short drive pin 64 mounted in the side wall 2 and a short journal pin or trunnion 68 disposed in the side wall 3. To replace the bipartite braking mechanisms 35, the suction members 41 must be separated from the braking rollers 34. This is effected by removing the brake bands 52 from the idlers 51 of the suction members 41. The middle, long support shaft section 67 can then be uncoupled from both of the couplings 66 and withdrawn as a complete unit together with the braking rollers 34 out of the machine, so that the actual exchange of the braking rollers 34 can be effected outside the machine. The exchange of the suction members 41 on the cross shaft 45 is performed separately therefrom, as previously described hereinabove.

As shown in FIG. 8, in a fourth embodiment of the bipartite braking mechanism 35 according to the invention, the support shaft is also of tripartite construction. At the free end of the drive pin 64 mounted in the side wall 2, an articulated joint 69 is secured to which the middle, long support shaft section 70 is linked. In the opposite side wall 3, a short coupling pin 71 is mounted, with which the other end of the middle support shaft section 70 is connected by means of the coupling 66. The short coupling pin 71 is turnable and withdrawable by the handle 36.

To exchange the bipartite braking mechanisms 35 of FIG. 8, the suction members 41 are separated from the braking rollers 34 exactly as in the hereinaforementioned third embodiment of the bipartite braking mechanisms shown in FIG. 7. Thereafter, the middle long support shaft section 70 is uncoupled by turning and withdrawing the short coupling pin 71 at the side wall 3 and can then be swiveled into selective positions, depending upon the particular articulated joint 69 employed, for exchanging the braking rollers 34.

As noted hereinbefore, the invention is naturally not limited to the specific embodiments shown in FIGS. 1 to 8 and described herein, but rather can, within the scope thereof, undergo most varied modifications with respect to the constructional details thereof. it is thus well within the scope of the invention to make the support shaft separable or uncouplable in the middle or at any other desired location thereof, or to dispose other suction braking rollers of conventional construction thereon.

There are claimed:

1. In sheet delivery apparatus for printing machines having a chain delivery device for delivering printed sheets to a delivery pile, pneumatic braking means comprising a plurality of discrete braking roller devices each having means for admitting suction air thereto and respectively having a sheet supporting surface of given width for supporting a printed sheet at non-printed areas thereof, a support shaft extending between side walls of the printing machine adjacent and upstream of the delivery pile in travel direction of the chain delivery device, said support shaft being disposed transversely to said travel direction below the chain delivery device, said plurality of discrete braking roller devices being mounted on said support shaft with the respective sheet supporting surfaces thereof engageable with respective non-printed areas of the sheet for braking and tightening the sheet, the respective sheet supporting surfaces being on respective parts of said braking roller devices which are continuously movable together with the sheet supported thereby in said travel direction of the chain delivery device, said plurality of braking roller devices being each individually exchangeable in the entirety thereof for other respective discrete braking roller devices having sheet supporting surfaces differing in width from said given width thereof so as to match varying widths on non-printed areas on respective printed sheets, the sheet supporting surface of differing width being on respective parts of said other discrete braking roller devices which are continuously movabhle together with the sheet supported thereby, said braking roller devices being of unipartite construction and comprising respective braking rollers formed in a sheet supporting surface thereof with suction chambers recessed therein and having a suction-air feed integral therewith, and drive means for rotating said braking rollers, said drive means comprising separate drive wheels for the respective braking rollers, said drive wheels being mounted on a drive shaft, fixed against rotation relative thereto and axially slidable thereon.

2. Sheet delivery apparatus according to claim 1 including support means mountable on said support shaft and secured thereto by clamping screws, and respective suction-air chamber sleeves by which said suction air feed is fixed while said braking rollers are rotatable on said support means.

3. Sheet delivery apparatus according to claim 1 wherein said drive means further comprise a pair of revolving drive belts, respectively, disposed on opposite sides of said suction chambers and connected to said drive wheels and said braking rollers.

4. In sheet delivery apparatus for printing machines having a chain delivery device for delivering printed sheets to a delivery pile, pneumatic braking means comprising a plurality of discrete braking roller devices each having means for admitting suction air thereto and respectively having a sheet supporting surface of given width for supporting a printed sheet at non-printed areas thereof, a support shaft extending between side walls of the printing machine adjacent and upstream of the delivery pile in travel direction of the chain delivery device, said support shaft being disposed transversely to said travel direction below the chain delivery device, said plurality of discrete braking roller devices being mounted on said support shaft with the respective sheet supporting surfaces thereof engageable with respective non-printed areas of the sheet for braking and tightening the sheet, the respective sheet supporting surfaces being on respective parts of said braking roller devices which are continuously movable together with the sheet supported thereby in said travel direction of the chain delivery device, said plurality of braking roller devices being each individually exchangeable in the entirety thereof for respective discrete braking roller devices having sheet supporting surfaces differeing in width from said given width thereof so as to match varying widths of non-printed areas on respective printed sheets, said braking roller devices being of bipartite construction and comprising a first part formed as a roller member, and a second part carried by said roller member and formed as a separate suction member having a suction-air feed integral therewith and a bearing a clamp, a cross shaft extending parallel to said support shaft between the side walls of the machine, said second part being slippable from above onto the cross shaft and removable upwardly therefrom by means of said bearing clamp, at least one of said braking rollers being formed with a narrow sheet-supporting surface, the respective suction member comprising two suction air chambers between which a single braking roller is disposed having a continuous middle cross piece, said braking means further comprising a braking belt wound around said middle cross piece of said braking roller, said braking roller having hub attachments on both sides of said middle cross piece as supports for said suction air chambers.

* * * * *